US005237139A

United States Patent [19]

Berg et al.

[11] Patent Number: 5,237,139

[45] Date of Patent: Aug. 17, 1993

[54] MICROWAVE OVEN, A METHOD FOR EXCITATION OF THE CAVITY OF A MICROWAVE OVEN, AND A WAVE GUIDE DEVICE FOR CARRYING OUT THE METHOD

[75] Inventors: Lars-Erik Berg, Kimstad; Per O. G. Risman, Sandsjön, both of Sweden

[73] Assignee: Whirlpool International B.V., Eindhoven, Netherlands

[21] Appl. No.: 753,499

[22] Filed: Sep. 3, 1991

[30] Foreign Application Priority Data

Sep. 21, 1990 [SE] Sweden ..... 9003012

[51] Int. Cl.[5] ..... H05B 6/64

[52] U.S. Cl. ..... 219/10.55 A; 219/10.55 B; 219/10.55 M; 219/10.55 F; 219/10.55 R; 99/DIG. 14; 426/243; 426/438

[58] Field of Search ..... 219/10.55 A, 10.55 F, 219/10.55 R, 10.55 M, 10.55 B; 99/DIG. 14; 426/243, 438

[56] References Cited

U.S. PATENT DOCUMENTS

| | | | |
|---|---|---|---|
| 3,493,708 | 2/1970 | Johnson | 219/10.55 F |
| 3,845,267 | 10/1974 | Fitzmayer | 219/10.55 A |
| 4,446,349 | 5/1984 | Smith | 219/10.55 F |
| 4,616,119 | 10/1986 | Shin | 219/10.55 F |
| 4,733,037 | 3/1988 | Nitta et al. | 219/10.55 F |
| 5,015,813 | 5/1991 | Yamada et al. | 219/10.55 F |

*Primary Examiner*—Geoffrey S. Evans
*Assistant Examiner*—Tu Hoang
*Attorney, Agent, or Firm*—Thomas J. Roth; Stephen D. Krefman; Thomas E. Turcotte

[57] ABSTRACT

This invention provides a microwave oven that is supplied with microwave energy through upper and lower feed openings in a side wall of the cavity. A wave guide is provided to feed those openings and is dimensioned to provide a resonance condition in the wave guide and a selected quality factor (Q-value) which is high in comparison with the Q-value of the oven cavity.

9 Claims, 2 Drawing Sheets

MICROWAVE OVEN, A METHOD FOR EXCITATION OF THE CAVITY OF A MICROWAVE OVEN, AND A WAVE GUIDE DEVICE FOR CARRYING OUT THE METHOD

BACKGROUND OF THE INVENTION

The invention is directed to a microwave oven comprising an oven cavity, a microwave source and a wave guide device connected thereto for supplying microwave energy from said microwave source to said cavity via two or more feed openings positioned at a distance from each other. The invention is also directed to a method for excitation of the cavity of a microwave oven with microwave energy via feed openings arranged at a distance from each other in a side wall of the cavity, and furthermore to a wave guide device for carrying out the method.

A general problem of microwave ovens is that the microwave energy has a tendency to establish an uneven heating distribution in the cavity, meaning that so called "hot" and "cold" spots establish at different places in the cavity. In turn this gives rise to an inferior cooking result, which specifically may be observed for goods of low thermal conductivity. The generally accepted explanation of this phenomenon is that so called standing wave patterns establish in the cavity, with the consequence that the electric field energy become distributed around bulges and nodes of said patterns, thereby giving rise to said "hot" and "cold" spots.

Several proposals for a solution of this problem are previously known and one can find a more detailed description of the problem and the prior art solution thereof by reference to, e.g. the U.S. Pat. Nos. 4,336,434 and 4,458,126. One solution uses a so called field stirrer, comprising from point of principle a metal wing provided in the cavity or in the microwave feed system in order to obtain a continuous change of said standing wave patterns or the power balance between the same. An improved cooking result may also be obtained by the use of a so called rotating bottom plate, on which the food is positioned and allowed to rotate during cooking, thereby providing a levelling out of the heating energy in the food.

Related methods for obtaining an improved cooking result use two or more feed openings for the microwave energy, also combined with different types of field stirrers, moving microwave reflectors and rotating bottom plate. "Dual feed" or "multiple feed" arrangements of this type are known from, e.g. the U.S. Pat. Nos. 3,364,332, 3,439,143, 3,742,177, 3,993,886, 4,133,997, 4,427,867 and 4,140,888.

Other solutions use a rotating antenna for feeding of the microwaves, being then usually positioned at the centre of the roof or bottom of the cavity. Examples of a solution of this type may be found in the SE patent specifications nos. 8006994-1 and 8700399-2, of which the last mentioned discloses a feed system that may be regarded as a combination of rotating antenna and "dual feed".

A serious complication and a ground for a varying quality of the cooking result is the fact that the microwave field distribution in the cavity is influenced by the load, that is the weight, the shape and the quality of the food and the vessel which is used for the food, as well as the position of the load in the cavity. In the case of said "dual feed" system this, as one example, may have the consequence under certain given load conditions, that feeding of microwave energy to the cavity practically takes place through only one of the feed openings, and thereby that intended equalization of energy is not obtained. Under such circumstances the persistent load mismatch between the cavity and microwave source, being usually a magnetron, causes energy to be reflected back to the magnetron and among other things influences the operation point thereof and brings with it a decreased microwave efficiency. Problems will also appear with respect to uneven heating due to screening.

Proposals which aim to decrease the degree of feedback or reflection of microwave energy to the microwave source are known from, for example, the U.S. Pat. Nos. 3,437,777 and 3,745,292. The solutions are based on among other things the use of so called directional couplers directing the reflected energy instead to a microwave load. Even if the very microwave source is protected by this measure, drawbacks also will appear due to the fact that microwave energy is lost in said load. Furthermore, arrangements of this type will increase the complexity of the oven construction and thereby produce increased costs.

Even if the prior art as mentioned above and as known from the recited patent specifications to a varying degree will contribute to a desireable microwave field distribution int he cavity, a cooking result which is completely satisfactory will nevertheless not be obtained, which in many cases is due to the strong dependency between the microwave field distribution and the actual load/food. Furthermore, the prior art solutions are very often relatively complicated with consequent increased manufacturing costs.

SUMMARY OF THE INVENTION

An object of the invention is to provide a microwave oven of the kind mentioned in the introductory part which avoids the drawbacks of the prior art and makes possible a desireable microwave field in the cavity which is less load dependent and thereby allows for an improved cooking result.

The object of invention is obtained by a microwave oven of the type mentioned in the introduction which is characterized in that said wave guide device is dimensioned for a degree of internal reflection such that a resonance condition is established in the wave guide device for the microwaves generated by the microwave source, and that said wave guide device has a selected quality factor (Q-value) which is high in comparison with the Q-value of the owen cavity for the current energy feed, the amount of microwave energy which is stored in the resonance condition being substantially greater than the energy flow which is transmitted to the cavity.

By the invention is obtained the advantage of a stabilization of the microwave feed through the feed openings, which means that the energy balance between the feed openings is substantially maintained even for varying load conditions in the cavity. Normally, the microwave source is impedance matched to the complete wave guide device. Because the complete devise is a passive three-port, the feed openings thereof to the oven cavity cannot be matched separately, but giving together nevertheless a matched system. By these measures is obtained a limitation of the energy which is reflected back to the microwave source, which contributes to a stabilization of the energy flow via said feed openings and to an improved efficiency.

One preferred embodiment of a microwave oven according to the invention is characterized in that said wave guide device comprises a straight wave guide of a rectangular section and provided along a vertical centre line of said sidewall with one broad side of the wave guide being directed towards, preferably integrated with, the cavity wall, said microwave source being connected to the opposite broad side of the wave guide at a point between said feed openings.

Further features of a microwave oven according to the invention are set out in the following claims.

The invention is also directed to a method of excitation of the oven cavity of a microwave oven with microwaves from a microwave source via first and second feed openings provided at a distance from each other, substantially along a vertical centre line of a side wall of the cavity. The object is to obtain a method which makes possible a more stable and less load dependent microwave field in the cavity and a more effective energy absorption in the load.

The object is obtained by the said method which is characterized in that first and second coherent and phase locked microwave energy flows, which correspond to said opening, are supplied to said cavity via the feed openings by a wave guide device resonant for the microwaves from the microwave source, and in that an interference field pattern is generated in the load zone of the cavity by interaction between said microwave flows.

One preferred embodiment of the method according to the invention is characterized in that said coherent microwave flows are phase locked in phase opposition at said feed openings, and in that said first microwave flow has a direction of propagation which is substantially horizontal and that said second microwave flow is inclined downwards, thereby providing a coherent interference field pattern in the load zone of the cavity with contributions mainly from the direct first microwave flow and from the second microwave flow after its reflection form the opposite side wall.

One further preferred embodiment of the method according to the invention is characterized in that said microwave flows are supplied at said feed openings with substantially a vertical E-field and a horizontal H-field.

Another embodiment of the method according to the invention is characterized in that heating maxima and minima are generated at unsymmetrical positions with respect to the centre area of the cavity load zone, being preferably a centre of rotation of a rotating bottom plate provided in the load zone, in which said positions are determined by selection of the mutual distance and/or inclination of the opposite side walls.

By the use of a resonant wave guide device for feeding microwave energy to the cavity and the stabilization of the microwave supply which is obtained thereby, a predictable interference field pattern may be obtained in the cavity, which substantially will not be influenced by changes of the load. Directing the microwave flows according to the invention has the consequence that the main part of the supplied microwave energy is converted in the load/food without any further reflections because the E-field polarisation in relation to the horizontal load surface is of a TM-type (so called pseudo-Brewster-incidence). This contributes to decreased cavity losses. This "direct" energy transfer to the load will dominate for loads which are not too small, but simultaneously with the interference field pattern appears as well a multimode resonant microwave field, a so called volume-mode, in the cavity. However this will not dominate until the loads become very small. One advantage for the adjustment of said modes is then that the depth of the cavity, i.e. the measure of the cavity from its front to its back wall, has a negligible influence on the interference field pattern and that the height of the cavity is relatively indifferent with respect to said TM-wave type. Therefore the depth of the cavity may be adapted in known manner only with respect to the volyme modes. The fact that feeding of microwave energy takes place at two points means a further simplification of this adaption.

It is underlined that a coherent excitation of a microwave oven cavity is known before from for example DE-A1-3.120.900. The disclosure of the publication, however, is written in a very general language and does not present a solution to the problem how to obtain a coherent feeding from a microwave source under varying load conditions. Specifically, nothing is said about the use of resonant wave guides according to the invention.

The invention is also directed to a resonant wave guide device for carrying out the method according to the invention for excitation of the oven cavity of a microwave oven with microwave energy from a microwave source via first and second feed openings arranged at a distance from each other, substantially along a vertical centre line of a cavity side wall.

In a wave guide device of this kind, among other things due to conditions with respect to space in the microwave oven, it is preferable to connect the microwave source to the wave guide at a point positioned between the feed openings. Thus, a wave guide device is obtained having wave propagation in two directions and problems, partly with establishing a standing wave in both directions for the desireable resonance conditions, partly with obtaining an impedance match between the microwave source and the wave guide device. It may be mentioned that conventional wave guide couplings make use of a shot circuit wall close to the magnetron antenna, whereby a standing wave in one direction and impedance matching is obtained.

One solution for obtaining an impedance match is known from DE-A1-30.29.035. The solution presented therein means that a specific matching element is introduced into the wave guide. Except the fact that this necessitates one extra component and its accompanying costs, sealing problems may arise as well.

A further object of the invention is to obtain a wave guide device of said type which avoids, among other things, the drawbacks of the prior art solution.

This object of the invention is obtained by a resonant wave guide device, which is characterized in that the wave guide device is dimensioned for the basic mode and comprises a straight wave guide of a rectangular cross section which extends between the feed openings. One broad side thereof is directed towards the cavity. The microwave source is connected into the opposite broad side of the wave guide via a box shaped bulge of the wave guide wall, said box shape extending cross the wave guide, being open towards the interior of the wave guide and having a position along the wave guide which is adapted to the wave length of the basic mode. The transverse sides of the box shape form two rectangular steps of a height which is adapted to the microwave source antenna. A centre hole is provided in the bottom of the box so that said antenna can be introduced into a position between said steps.

The box shaped bulge in a simple way allows for the desireable resonance condition, and at the same time the necessary impedance match to the microwave source is obtained. In a wave guide device of this kind the antenna of the microwave source, i.e. usually the magnetron, must be positioned at a specified minimum distance from the opposite wave guide wall in order to obtain a good durability of the magnetron. By means of the box shaped bulge according to the invention, this distance may be obtained for a lower height of the wave guide itself, saving thereby further space.

Preferred embodiments of the wave guide device according to the invention are disclosed in the patent claims.

BRIEF DESCRIPTION OF THE DRAWINGS

The invention and its advantages will be more closely described in the following with reference to the drawings, in which.

DESCRIPTION OF THE PREFERRED EMBODIMENTS

Figure 1:
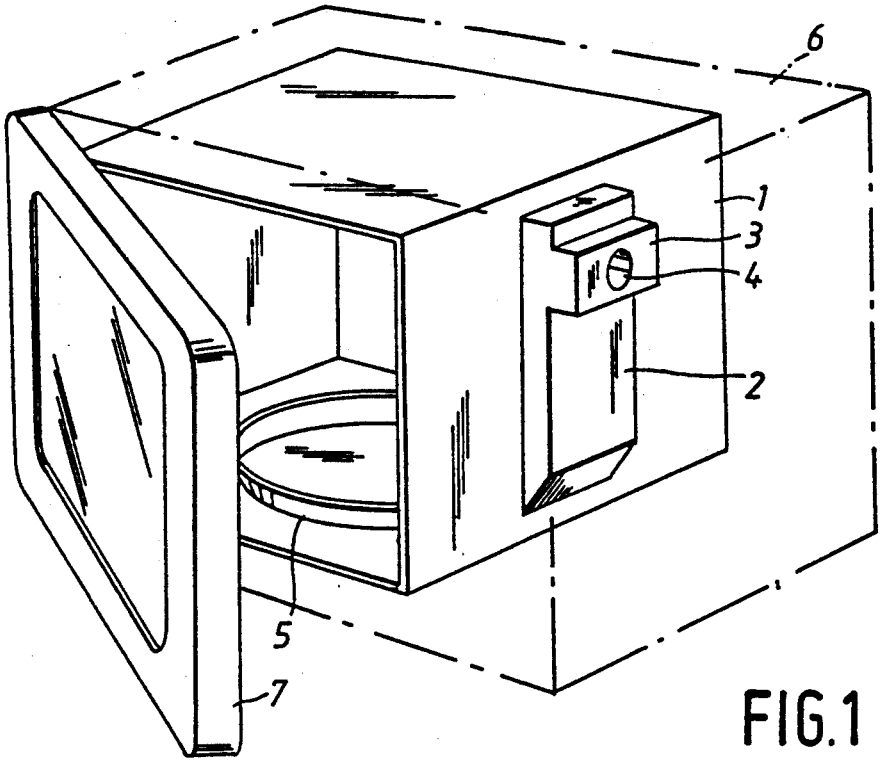
FIG. 1 shows schematically a microwave oven according to the invention.

FIG. 1 shows a microwave oven according to the invention, comprising an oven cavity 1, a wave guide device 2 arranged on one side wall of the oven cavity and on one side of which is provided a bulge 3 having a hole 4 for the coupling antenna of the microwave source to be introduced therein, the microwave source being a standard magnetron with the frequency 2.45 GHz (now shown). In the load zone of the cavity is provided a rotating bottom plate 5 on which the load, for example a piece of food or a vessel holding a liquid, is placed and rotates during the preparation/cooking. FIG. 1 shows furthermore schematically an oven cover 6 and an oven door 7 for closing the cavity during preparation.

A microwave oven comprises furthermore a power supply connected to the mains and generating a high voltage for the magnetron, and control means for controlling said power supply with respect to among other things cooking time and power levels. The power supply and said control means are of a common type and have not been shown in the interest of simplification and because the same lie outside of the scope of invention. Embodiments thereof may be exemplified by the Philips microwave oven of type AVM 730.

Figure 2:
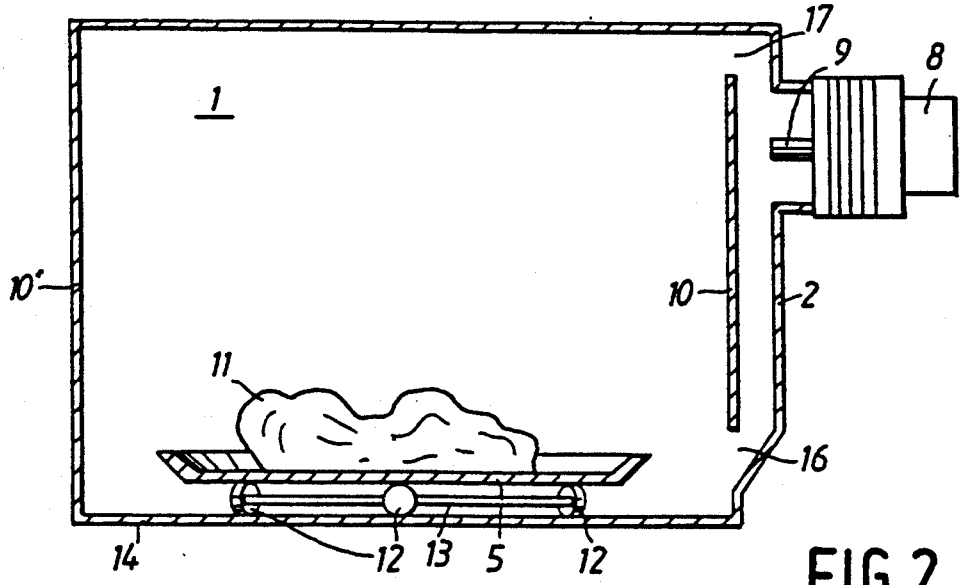
FIG. 2 shows a partly sectioned side elevation of the oven cavity in FIG. 1.

FIG. 2 shows a partly sectioned side elevation of the cavity 1 with the wave guide device 2 and a magnetron 8 which is mounted thereon and the coupling antenna 9 of which is introduced through the hole 4 shown in FIG. 1. In the disclosed embodiment the wave guide device 2 is integrated with the cavity, meaning that the broad side of the wave guide which is directed towards the cavity is formed by a corresponding part of the cavity side wall 10. In the interest of simplification, the opening 17 has been shown in direct connection to the cavity roof.

In the cavity the rotating bottom plate 5 is provided, carrying the actual load 11. The bottom plate 5 rests against the cavity bottom via three schematically shown wheels 12, each being journalled in bearings at the end of a separate corresponding leg of a wing 13. The wing 13 may comprise a central part having three legs of equal length extending therefrom, said legs forming mutually an angle of 120°. A wing of this type is normally rotated by means of an electric motor (not shown) the torque axle of which is introduced through the cavity bottom 14 and is connected to said centre part. When the wing is brought into rotation in the plane of the bottom plate 14, said wheels 12 will roll against the cavity bottom and thereby bring the bottom plate 5 into rotation.

In the cavity side wall 10 is provided one lower and one upper feed opening 16 and 17 respectively, said openings being coupled to the wave guide device 2 for feeding of microwaves from the magnetron 8 to the cavity.

The wave guide 2 is dimensioned so that a resonance condition is established in the wave guide device. This may be obtained by making the output openings of the wave guide of approximately equal size and each having a small coupling coefficient $<1$. Said resonance condition furthermore requires a phase lock of the microwaves at the respective feed openings 16 and 17, and then preferably in phase opposition, which has turned out to provide a stable field pattern and a good energy absorption in the load. Except some given minimum measures which are required for the desireable switch in, this means that the length of the wave guide device may be chosen in steps of about $\lambda g/2$, in which $\lambda g$ is the microwave length of the basic mode of the wave guide device. For the embodiment of the wave guide which has been chosen, the switch in is made in phase opposition, giving also maximum distance between the feed openings 16 and 17, within the frame of a useful cavity height of 200–250 mm. From the following description of FIG. 4 will be clear that the phase opposition feed furthermore makes it possible to position heating maxima at the bottom plate 5. In phase feeding is also possible from a principal point of view, but then said maxima will be moved to an area around a horizontal line starting from a point right between the feed openings.

Figure 3:
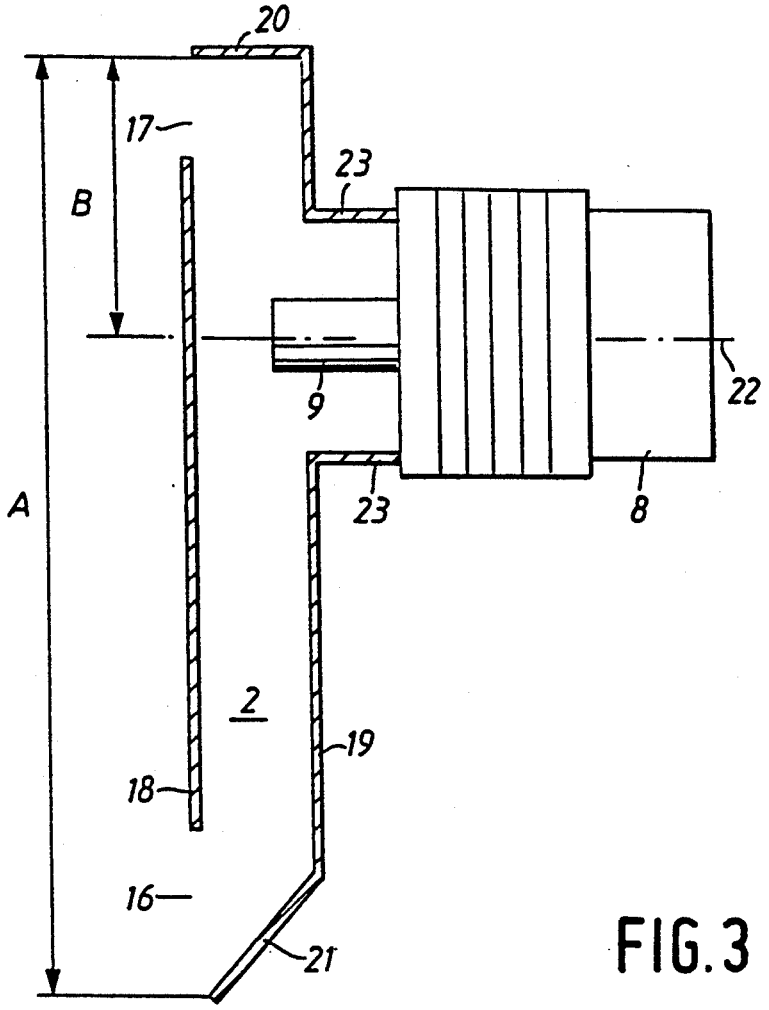
FIG. 3 shows a partly sectioned side elevation of a resonant wave guide device having a microwave source mounted thereon according to the invention.

FIG. 3 shows a partly sectioned side elevation of the wave guide device 2 with the magnetron 8 mounted thereon. The magnetron antenna 9 is introduced into the wave guide device via the box shaped bulge 3 (see FIG. 1). As is clear from FIG. 1 the wave guide device comprises a straight wave guide of a rectangular cross section, of which one broad side 18 is directed towards the cavity and in this embodiment is formed by a corresponding part of the cavity wall 10 (see FIG. 2). The opposite broad side 19 of the wave guide at the upper feed opening 17 proceeds into an inclined wall 20, and at the lower feed opening 16 into an inclined wall 21. The box shaped bulge 3 defines two steps 23 of equal length which are positioned symmetrically with respect to the coupling antenna 9 of the magnetron.

The total length of the wave guide and the position of the two steps 23 along the wave guide have been established experimentally. The requirement is that so called $TE_{10}$-waves shall be established in both arms of the wave guide in order to obtain microwave flows having substantially a vertical E-field and a horizontal H-field at the feed openings 16 and 17. Furthermore the microwave flows at the openings 16 and 17 shall appear in phase opposition. It is also a requirement that the magnetron and the wave guide device shall be impedance matched.

For dimensioning of the wave guide the following experimentally defined formula has been used with reference to the lengths A and B in FIG. 3:

$$A-B=(k+n\cdot 0.5)\lambda g$$

in which:

A = the total length of the wave guide measured from the upper edge of the upper feed opening 17 to the lower edge of the lower feed opening 16

B = the wave guide length measured from the centre axis 22 to the upper edge of the upper feed opening 17 k = a constant with a value in the interval 0.7–0.9 n = 0,1,2,3, . . .

λg = the wave length of the basic mode of the wave guide.

Since the length according to this formula is a function of λg, the advantage is obtained that the width and the length of the wave guide may be adapted mutually with eh resonance, impedance match, efficiency and cavity field pattern maintained.

The position of the box shaped bulge 3, and therefore of the steps 23 along the wave guide has been experimentally tested in such a way that $TE_{10}$-waves and a resonant standing wave condition is established in both arms of the wave guide device. The electrical length of the wave guide may not be calculated in simple manner from the geometrical measures, because partly the phase of the standing wave at the ends is not completely clear due to the different shapes of the wave guide at the openings 16 and 17, partly because the wave pattern in the coupling zone of the magnetron is not at all completely clear. In this embodiment the wave guide has a total length A = 205 mm by using the formula given above. With these dimensions the desirable microwave flows are established at the openings 16 and 17 in phase opposition.

The impedance match between the magnetron 8 and the wave guide 2 is determined by the distance between the steps 23 and the coupling antenna 9. It is also required that a distance of about the same order of size be provided between the end of the coupling antenna 9 and the opposite wave guide side wall 18. Because the magnetron is connected to the wave guide device via said box shaped bulge 3, said distance between the end of the coupling antenna and the wave guide wall is achieved and thereby also the desireable impedance match in the coupling zone of the magnetron, but the remaining part of the wave guide may have a lower height, which saves space and facilitates the arrangement of further components in the microwave oven.

The wave guide device 2 has a selected quality factor (Q-value) which is high in comparison with the Q-value of a $TE_{10}$-wave guide having a free one way transmission, and also high in relation to the Q-value of the cavity for the actual feed condition. In this embodiment the Q-value is around 50 as measured for free radiation using the feed openings as shown. When connected to the cavity in a situation when the cavity comprises a load which is big under the circumstances, the Q-value is somewhat bigger.

The resonance condition in the wave guide device and the high Q-value thereof have the consequence that the oscillating amount of energy, which is stored in the resonance condition, is much bigger than the energy which is transmitted to the cavity. This contributes to the fact that the locking in phase opposition of the microwaves from the respective feed openings is maintained when the load is changed and specifically also for relatively small loads, thereby making possible a coherent, phase locked excitation of the cavity which is substantially independent of the load.

Figure 4:
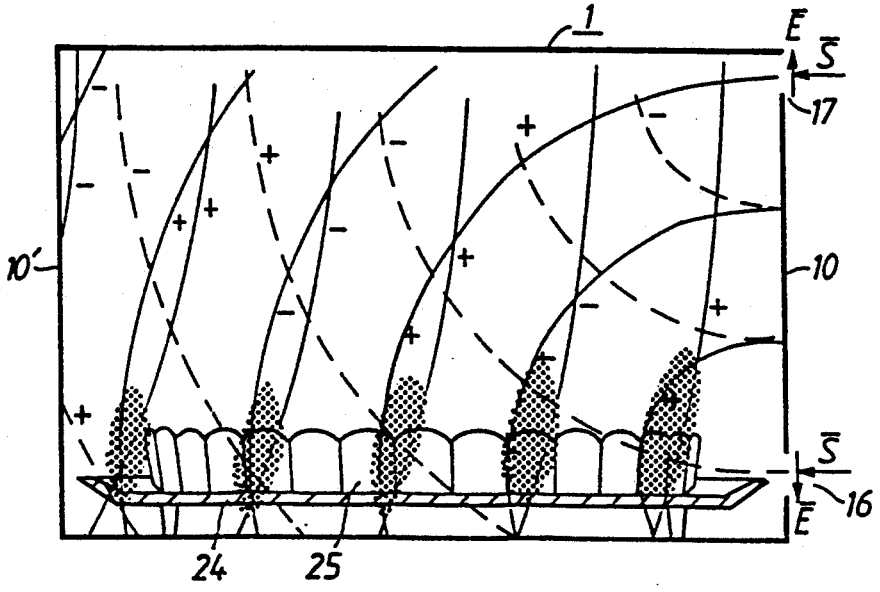
FIG. 4 illustrates the interference field pattern in the oven cavity.

FIG. 4 shows a stand still bottom plate 24 at the bottom of the cavity 1 having a load 25 placed thereon. Microwaves are supplied via the feed openings 16 and 17 via the wave guide device 2 (not shown.) As in FIG. 2, the opening 17 has been shown in direct connection with the cavity roof. At the feed openings the generated microwave energy flows have a horizontal direction of propagation according to the vector S, the E-field being substantially vertical and in phase opposition at the respective openings, which is indicated by the downwardly pointing vector E at the opening 16 and the upwardly pointing vector E at the opening 17.

FIG. 4 discloses a simplified two dimensional illustration of the manner in which the interference field pattern according to the invention is established, that is by interference between mainly the direct wave from the opening 16, the radiation lobe of which is substantially directed horizontally left, and the microwaves from the opening 17 after reflection once in the opposite side wall, the radiation lobe of which is directed inclined downward left, the direct wave from the opening 17 contributing as well. Wave maxima and wave minima of the waves from the respective openings are indicated by circular arcs designated + respectively −, full line circular arcs being used for the direct wave from the lower opening and dashed circular arcs for the direct wave from the upper opening, while full line circular arcs also have been used for the microwaves from the upper opening after reflection from the opposite side wall, changing phases/changing signs by the reflection. Interaction between the said three wave propagations will then provide intensity maxima in the shaded parts of the oven cavity, the figure of being however not intended to show the wave propagation in the load itself. It is essential that the E-field vector of the microwave flows interacting in this manner forms a large angle relative to an imaginary plane load (so called pseudo-Brewster-incidence), which makes it possible that the main part of the microwave energy is absorbed in the load before the occurrance of further reflections. Simultanously with the shown interference field pattern exists as well a multi-resonance field in the cavity. The influence of this field on the load will not dominate until the load becomes very small, typically <200 g, when the energy absorption in the load by the described interference will be less. The load is also influenced by the direct wave from the opening 17 to a comparatively small degree due to among other things the unfavourable direction of its E-field in relation to the load.

The distance between intensity maxima in FIG. 4 is about 6 cm for the wavelengths in question. The positions of these maxima relative to the centre of the bottom plate, for example the centre of rotation of a rotating bottom plate, may be influenced by adapting the distance between the cavity side walls 10 and 10'. Also the mutual angular position of the side walls may be used for this positioning. By these measures it is possible to avoid that an intensity maximum or minimum is established at said centre and thereby a hot or cold spot in the load. FIG. 4 discloses an adequate asymmetrical adjustment of said maxima/minima. It is also possible to provide a minima within the edge area of the bottom plate in order to minimize the risk of edge burning of the load.

Due to the high Q-value of the wave guide device 2 the so called wave guide losses are increased in comparison with the losses of a single matched wave guide. The power losses may be limited by the use of a metal of good electric conductivity. Because the larger part of the field energy is absorbed by the load without repeated reflections as described above, the so called wall losses in the metal walls of the cavity are decreased in comparison with a multi resonance cavity of a traditional type. Dependent on the extension of the load, good energy absorption in the load because the direction of the radiation lobes from the openings 16 and 17 will provide a long distance of propagation along the load with a favourable E-field direction with only one reflection, decreased cavity losses and somewhat increased wave guide losses, all together allows for an improved microwave efficiency in comparison with prior art ovens. To this contributes as well the phase stability of the wave guide device due to the high Q-value and internal resonance thereof, substantially eliminating feedback of microwave energy from the cavity to the magnetron and thereby a substantially maintained operating point and efficiency of the magnetron independent of the size of the load.

We claim:

1. A microwave oven comprising: an oven cavity, a microwave source and a wave guide device connected thereto for supplying microwave energy from the microwave source to the cavity via at least two feed openings positioned at a distance from each other, a wave guide device dimensioned to provide a degree of internal reflection whereby a resonance condition is established in the wave guide device for microwaves generated by the microwave source, and wherein the wave guide device has a selected quality factor which is higher in comparison with a quality factor of the oven cavity for a given current feed, and the microwave energy which is stored in the resonance condition being substantially greater than the microwave energy which is transmitted to the cavity.

2. A microwave oven as claimed in claim 1 comprising first and second feed openings positioned at the bottom and roof, respectively, of the cavity and provided in a side wall of the cavity, wherein said wave guide device comprises a straight wave guide of a rectangular cross section and arranged along a vertical centre line of the side wall with a first broad side of the wave guide directed towards, and integrated with, the cavity wall, the microwave source being connected to a second broad side opposite said first broad size of the wave guide at a point between said feed openings.

3. A microwave oven as claimed in claim 2, wherein the openings of the wave guide are shaped to generate microwaves having substantially a vertical E-field, a horizontal H-field and being in phase opposition, the microwave flow from the opening at the cavity bottom having substantially a horizontal direction of propagation and the microwave flow from the opening adjacent the cavity roof being inclined downwards and towards the opposite side wall of the cavity, whereby heating maxima and minima are obtained in the load zone of the cavity by interference substantially between the microwave flow from the first opening and the microwave flow from the second opening after its reflection from the opposite side wall.

4. A microwave oven as claimed in claim 3, wherein mutual distance and inclination of said opposite side walls has been selected in relation to the distance between the feed openings whereby said heating maxima and minima are obtained at places positioned unsymmetrically with respect to the centre area of the load zone.

5. A microwave oven as claimed in claim 2 further comprising a rotating bottom plate provided in the load zone of the microwave oven, on which the load is rotated during a preparation interval.

6. A microwave oven as claimed in claim 1 further comprising a rotating bottom plate provided in a load zone of the microwave oven, on which the load is rotated during the preparation interval.

7. A method of excitation of an oven cavity having a load zone in a microwave oven with microwave energy from a microwave source via first and second feed openings provided at a distance from each other and essentially along a vertical centre line of a side wall of the cavity, which method comprises: supplying to the cavity via said feed openings and a wave guide device, first and second coherent and phase locked microwave energy flows which correspond to said openings, the wave guide device being resonant for the microwaves from the microwave source, thereby an interference field pattern is generated in the load zone of the cavity by interaction between said microwave energy flows, said pattern having heating maxima and minima at unsymmetrical positions with respect to a centre area of the cavity load zone.

8. A method as claimed in claim 7, wherein said microwave energy flows are supplied at the feed openings with substantially a vertical E-field and a horizontal H-field.

9. A method as claimed in claim 7, wherein said heating maxima and minima generated at unsymmetrical positions with respect to the centre area of the cavity load zone are generated by said positions being determined by selection of a mutual distance and inclination of the opposite side walls.

* * * * *